US005711488A

United States Patent [19]

Lund

[11] Patent Number: 5,711,488

[45] Date of Patent: Jan. 27, 1998

[54] HIGH PRESSURE SWIRL ATOMIZER

[75] Inventor: Mark T. Lund, West Chester, Ohio

[73] Assignee: The Procter & Gamble Company, Cincinnati, Ohio

[21] Appl. No.: 543,006

[22] Filed: Oct. 13, 1995

[51] Int. Cl.[6] ..... B05B 1/34

[52] U.S. Cl. ..... 239/333; 239/492

[58] Field of Search ..... 239/333, 461, 239/463, 491, 492

[56] References Cited

U.S. PATENT DOCUMENTS

| | | | |
|---|---|---|---|
| 3,994,442 | 11/1976 | Hoening . | |
| 4,071,196 | 1/1978 | Burke et al. | 239/492 |
| 4,076,174 | 2/1978 | Volgel et al. . | |
| 4,260,110 | 4/1981 | Werding . | |
| 4,322,037 | 3/1982 | Heeb et al. | 239/492 X |
| 4,979,678 | 12/1990 | Ruscitti et al. . | |
| 5,064,122 | 11/1991 | Kamishita et al. | 239/491 X |
| 5,269,495 | 12/1993 | Dobbeling . | |
| 5,388,766 | 2/1995 | Buisson | 239/492 X |

FOREIGN PATENT DOCUMENTS 0412524 2/1991 European Pat. Off. .

OTHER PUBLICATIONS

Chigier, Norman; Atomization and Sprays 2000; Carnegie Mellon University, Pittsburgh, PA 15213–3890; pp. 1 through 25.

*Primary Examiner*—Andres Kashnikow
*Assistant Examiner*—Robin O. Evans
*Attorney, Agent, or Firm*—Daniel F. Nesbitt

[57] ABSTRACT

An atomizing nozzle having a plurality of vanes, a swift chamber, and a discharge orifice is provided for dispensing a liquid spray. The plurality of vanes extend outwardly from the swirl chamber and are in fluid communication therewith. The discharge orifice is generally concentric and in fluid communication with the swift chamber. The atomizing nozzle provides a fine atomized spray when used in manually-actuated pump type dispensers.

13 Claims, 4 Drawing Sheets

HIGH PRESSURE SWIRL ATOMIZER

TECHNICAL FIELD

The present invention relates generally to the field of fluid atomization, and more particularly to an improved fluid atomizing nozzle for use in manually-actuated pump dispensers which is capable of generating a fine liquid spray.

BACKGROUND OF THE INVENTION

Fluid atomizing nozzles are widely used in applications for dispensing of various consumer hygiene, health, and beauty care products (e.g., hair spray dispensers, aerosol deodorant spray dispensers, nasal spray dispensers and the like). More specifically, devices incorporating fluid atomizing nozzles for dispensing consumer products are generally of either the manually-actuated pump type or the aerosol type. Manually-actuated pump dispensers typically include a piston and cylinder arrangement which converts force input by the user (e.g., squeezing a pump lever or depressing a finger button) into fluid pressure for atomizing the liquid product to be dispensed. The liquid product is generally directed into an atomizing nozzle having a swirl chamber where the rotating fluid forms a thin conical sheet which breaks into ligaments and discrete particles or drops upon exiting to the ambient environment.

Aerosol dispensers, on the other hand, typically incorporate a pressurized gas (e.g., generally a form of propane, isobutane or the like) which is soluble with the liquid product to aid in atomization. When the liquid product is discharged from the dispenser, much in the same manner as with a manually actuated dispenser, the gas "flashes off" (i.e., separates out of the liquid and returns to its gaseous state), thereby assisting the atomization process by causing some of the liquid to break apart into ligaments and discrete particles or drops. Thus, the liquid in an aerosol type dispenser is atomized by both the phase change of the pressurized gas as well as by the swirling motion of the liquid as it exits the swirl chamber. It has been found, however, that aerosol propellants are often not preferred such as for reasons of environmental concerns for example. Nozzles designed for operation with an aerosol dispenser, however, will generally not produce the same spray characteristics when adapted for use in a manually-actuated pump dispenser.

The spray characteristics of an atomizing nozzle (e.g., drop size, spray angle, spray penetration and patternation) can be important for achieving consumer satisfaction with a dispensed product. For example, in hair spray applications, it can be advantageous to generate a spray having a smaller mean particle size (e.g., generally about 40 microns), as sprays with larger particle sizes may create a perceptively "wet" or "sticky" spray because the drying time for the larger particles is correspondingly longer. One method for decreasing an atomized spray's mean particle size is to increase the liquid pressure, which, in turn, increases the angular velocity of the liquid within the swirl chamber and generally results in a thinner film and hence a finer spray. However, because the required increase in pressure must generally be accomplished in a manually-actuated pump dispenser by increasing the hand actuation force, this type of dispenser may be less desirable to consumers because of the increased effort required for its operation. Consequently, an atomizing nozzle which can generate a spray having the desired mean particle size of about 40 microns with the lowest possible hand actuation force would be desirable for use in manually-actuated pump dispensers. Heretofore, this combination of features has not been available.

The spray characteristics of an atomizing nozzle are generally a function of the viscosity of the liquid to be dispensed, the pressure of the liquid, and the geometry of the atomizing nozzle (e.g., orifice diameter, swirl chamber diameter, vane cross sectional areas and the like). The prior art in the fluid atomizing industry discloses a variety of fluid atomizing nozzles for use in manually-actuated pump dispensers or, in aerosol dispensers, in which these parameters have been combined to achieve specific spray characteristics. For example, commercially available atomizing nozzles may be adapted for use in manually-actuated pump dispensers of consumer products. The commercial atomizing nozzles of which the applicant is aware are generally comprised of a plurality of generally radial vanes which exit into a swirl chamber being generally concentric with a discharge orifice. These known atomizing nozzles typically have a swirl chamber diameter in a range of between about 0.75 mm and about 1.5 mm, an individual vane exit area in a range of between about 0.045 mm and about 0.20 mm, and a discharge orifice diameter in a range of between about 0.25 mm and about 0.50 mm. It has, however, been observed by the applicant that in order for these atomizing nozzles to form a spray having the desired 40 micron particle size, fluid inlet pressures greater than or equal to 200 psig are required.

In the patent area, U.S. Pat. No. 4,979,678 to Ruscitti et at. discloses an atomizing nozzle having a series of spiral turbulence channels which exit into a turbulence chamber that is coaxial with the nozzle exit orifice. U.S. Pat. No. 5,269,495 to Dobbeling similarly illustrates a high pressure atomizer having a liquid feed annulus, a plurality of straight radial supply ducts, and a turbulence chamber with an exit orifice. The liquid enters the turbulence chamber through the radial supply ducts where it impinges upon liquid entering from an opposing turbulence duct. This impingement is to create a "shearing action" which allegedly atomizes the liquid. This atomizer, however, is taught as requiring, inlet fluid pressures approaching 2200 psig to achieve this "shearing" effect.

While the above discussed prior atomizing nozzles may function generally satisfactorily for the purposes for which they were designed, it is desirable to provide an improved atomizing nozzle with structural and operational advantages of finer spray characteristics with convenient and efficient manual activation. Heretofore there has not been available an atomizing nozzle for use in a manually-actuated pump dispenser having a simple, easily manufacturably swirl chamber and vanes which would he capable of producing an atomized liquid spray having a 40 micron or less mean particle size with a required activation liquid pressure generally below 200 psig.

SUMMARY OF THE INVENTION

An atomizing nozzle is provided which is capable of producing a spray of liquid product having about a 40 micron particle size with an activation liquid pressure of about 160 psig. The atomizing nozzle comprises a supply structure for transporting a pressurized liquid from a container, a plurality of generally radial vanes, a swirl chamber having a chamber diameter, and a discharge orifice having an orifice diameter.

The plurality of vanes are in fluid communication with the swirl chamber and have a generally decreasing individual vane cross sectional area toward the swirl chamber. The swirl chamber is similarly in fluid communication with the discharge orifice for releasing an atomized liquid product to the ambient environment. The plurality of vanes preferably have a cumulative vane exit area being in a range of between about 0.18 $mm^2$ and about 0.36 $mm^2$ in combination with a swirl chamber diameter of between about 1.3 mm and about 2.0 mm. It is more preferred, however, that the plurality of vanes consists of three vanes with each vane having an individual vane exit area being in a range of between about 0.06 $mm^2$ and about 0.12 $mm^2$, and with the discharge orifice having an orifice diameter being about 0.35 mm.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE PREFERRED EMBODIMENTS

Figure 1:
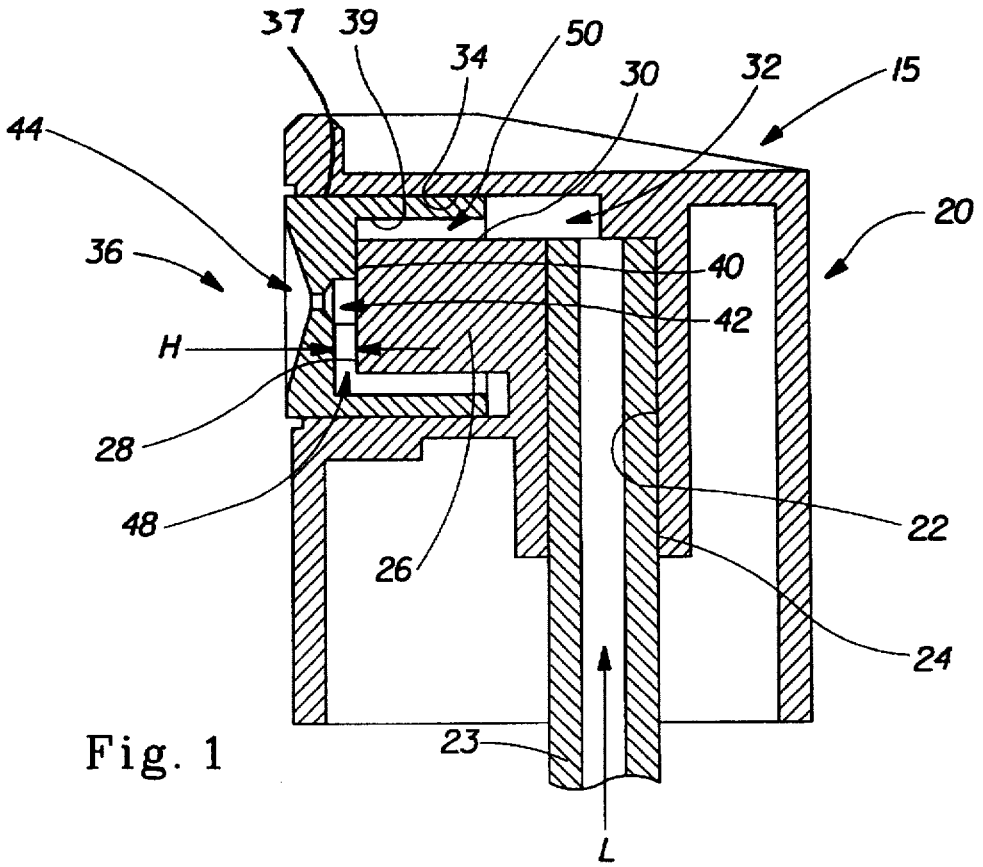
FIG. 1 is an enlarged cross sectional view of an atomizing nozzle made in accordance with the present invention.
Figure 2:
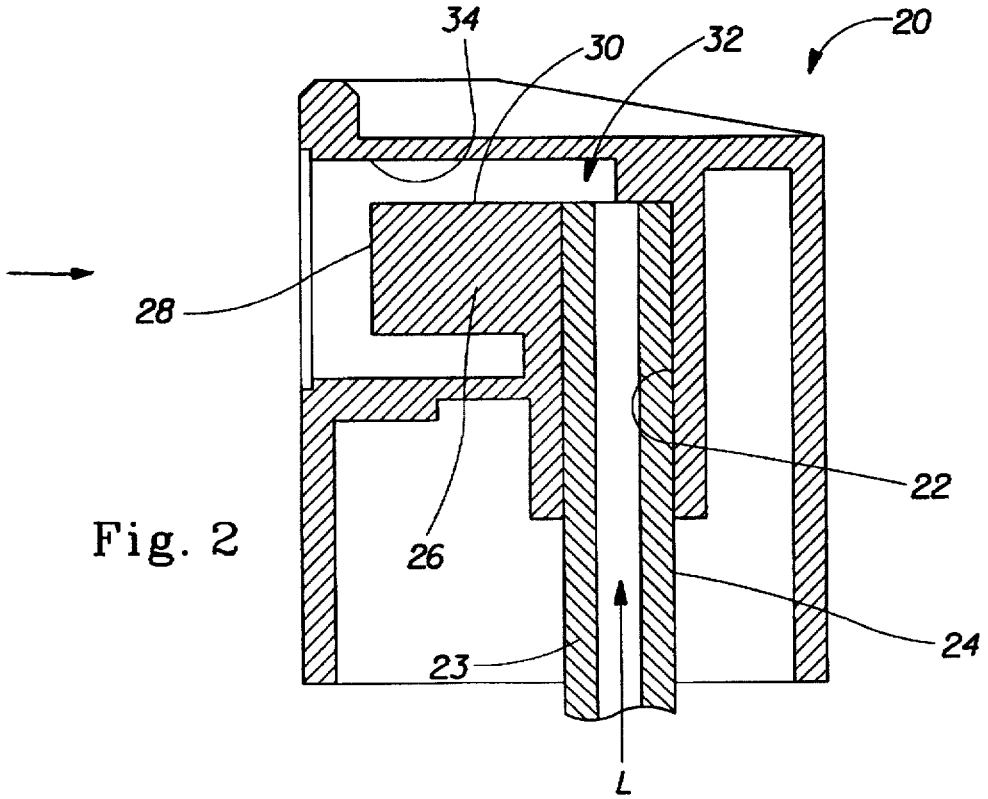
FIG. 2 is an enlarged cross sectional view of the nozzle body of FIG. 1, illustrated without its nozzle insert for clarity.

Reference will now be made in detail to the present preferred embodiments of the invention, an example of which is illustrated in the accompanying drawings wherein like numerals indicate the same elements throughout the views. FIG. 1 is an enlarged cross sectional view of an atomizing nozzle 15 made in accordance with the present invention for use in a manually-actuated pump type liquid product dispenser. Atomizing nozzle 15 comprises a nozzle body 20 and a nozzle insert 36. As best illustrated in FIGS. 1 and 2, nozzle body 20 can preferably be provided with a generally cylindrically shaped interior and may have various external configurations or structures which may aid the user in operation of the dispenser (e.g., raised gripping surfaces, depressions for finger placement and the like). Nozzle body 20 is further illustrated as including nozzle feed passage 22 disposed therein for receiving feed tube 23, such as by a frictional interference fit between passage 22 and feed tube outer surface 24. The frictional connection, more commonly known as a press fit, between feed tube outer surface 24 and nozzle feed passage 22 can preferably be snug but removable to facilitate cleaning or rinsing of debris which may otherwise build up and clog the atomizing nozzle.

Preferably, the corresponding surfaces of nozzle feed passage 22 and feed tube outer surface 24 are provided of appropriate size and material to effectively create a seal therebetween so that there will be generally no liquid flow between the surfaces when the dispenser is in operation. Although it is preferred that nozzle feed tube 23 be retained by simple frictional interaction with nozzle feed passage 22, it will be understood by one skilled in the art that feed tube 23 may be connected to nozzle feed passage 22 by alternate means such as adhesive connections, welding, mechanical connecting structures (e.g., threads, tabs, slots, or the like), or by integral manufacture with nozzle passage 22.

Feed tube 23 is to provide fluid communication with a suitable liquid storage container (not shown) so that the liquid product to be dispensed may be transported from the container to atomizing nozzle 15. Feed tube 23 may preferably form part of a valve stem for a conventional piston and cylinder arrangement or other dispensing arrangement (not shown) which generates the liquid pressure required for operation of atomizing nozzle 15.

A generally plug-shaped insert post 26 is preferably disposed adjacent feed tube 23, as best illustrated in FIGS. 1 and 2. Insert post 26 preferably has a substantially planar end surface 28 adjacent its distal end, and insert post surface 30. End surface 28 is generally circular shaped when viewed from the direction indicated by the arrow in FIG. 2. Insert post 26 can be a separate structure which may be attached to nozzle body 20 by a mechanical means (e.g., threaded, press fit or the like), but will preferably be integrally formed with nozzle body 20 for simplicity of manufacture (such as by injection molding). Supply chamber 32 generally forms an annulus which is bounded by post surface 30 and inside wall 34. Preferably, supply chamber 32 is adjacent to and in fluid communication with feed tube 23 to initially receive fluid from the storage container.

Figure 3:
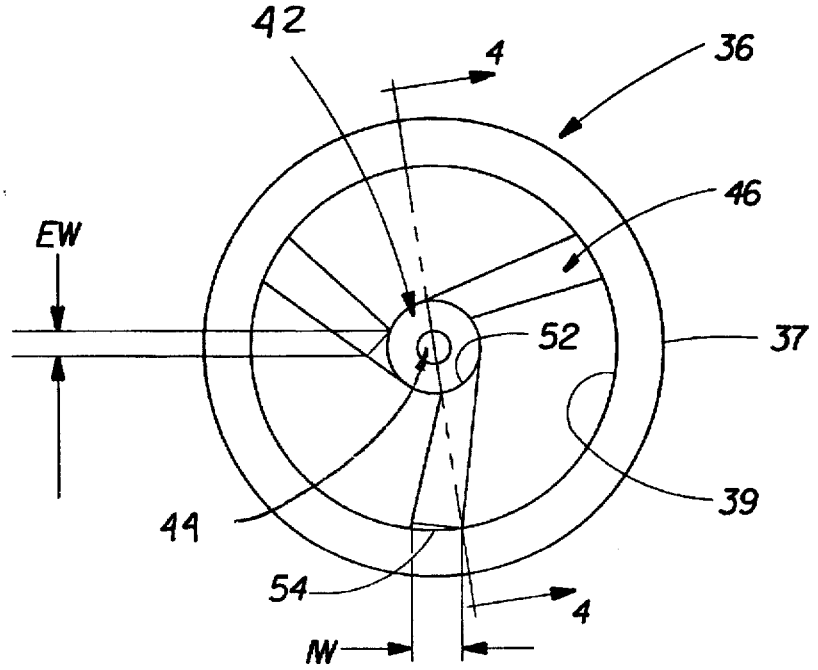
FIG. 3 is a rear elevational view of the nozzle insert of the atomizing nozzle of FIG. 1.
Figure 4:
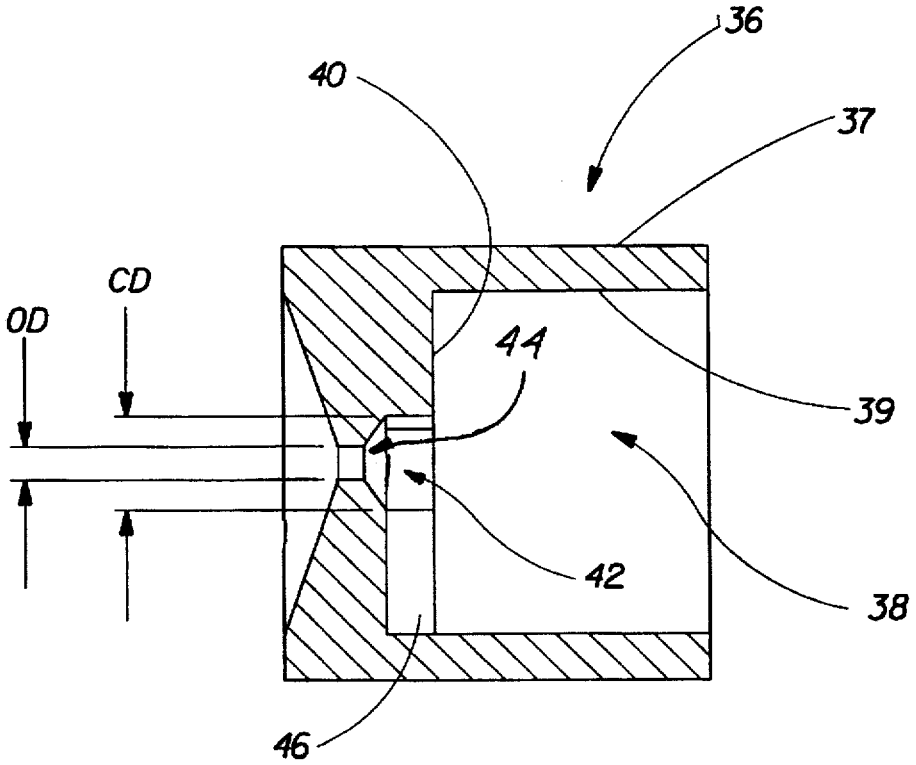
FIG. 4 is an enlarged cross sectional view of the nozzle insert in FIG. 3, taken along line 4—4 thereof.

As best seen in FIGS. 3 and 4, nozzle insert 36 is preferably generally cup-shaped, having a cavity 38 with a cavity surface 39 and an end face 40. Located adjacent to end face 40 and generally concentric with the centerline of 38 is swirl chamber 42, illustrated with a chamber diameter CD. Swirl chamber 42 preferably has a generally conical shape for flow efficiency (i.e, minimal pressure drop), although other common conformations such as bore shapes may also be suitable.

A discharge orifice 44 having a predetermined orifice diameter (OD) is preferably located adjacent to and generally concentric with swirl chamber 42. Discharge orifice 44 thereby provides fluid communication between swirl chamber 42 and the ambient environment. As best illustrated in FIG. 3, a plurality of grooves 46 are preferably disposed on end face 40 extending generally radially inward from cavity surface 39 to conical swirl chamber 42. In a preferred embodiment, each groove 46 connects generally tangentially with swirl chamber 42 and nozzle insert 36 has at least two spaced grooves 46. In the embodiment shown, nozzle insert 36 has three grooves 46 disposed generally radially and equidistant about swirl chamber 42, as best illustrated in FIG. 3.

The inside wall 34 of supply chamber 32 is preferably sized to receive and frictionally retain nozzle insert 36. Alternatively, nozzle insert 36 may include a ring or other locking device (not shown) for mechanically mating with a slot or similar structure corresponding with the locking device (not shown) and disposed about inside wall 34 so that nozzle insert 36 will be positively retained within nozzle body 20. Preferably, the surfaces of inside wall 34 and insert surface 37 are sized such that when assembled in contact with each other, they will create an effective seal and there will be generally no liquid flow between the surfaces when the dispenser is in operation.

When nozzle insert 36 has been fully assembled with inside wall 34 of nozzle body 20 such that end surface 28 and end face 40 are in contact (as best illustrated in FIG. 1), a plurality of generally rectangular vanes 48 and a supply annulus 50 are defined. Supply annulus 50 is preferably formed between cavity surface 39 and post surface 30, and extends along at least a portion of the length of cavity surface 39 such that supply annulus 50 is in fluid communication with both supply chamber 32 and one or more contiguous vanes 48.

Vanes 48 are preferably defined by the juxta position of end surface 28 of insert post 26 and grooves 46 of insert 21. Each vane 48 has a resulting width W and height H which, in turn, defines a vane cross sectional area A in accordance with the equation:

$$A=W*H$$

Thus, the individual vane exit area EA of each vane exit 52 is the product of exit width EW of that vane and height H, while the individual vane inlet area IA of each vane inlet 54 is similarly the product of height H and the inlet width IW. The cumulative vane inlet area for an atomizing nozzle made in accordance with this invention is, therefore, the summation of the individual vane inlet areas IA while similarly the cumulative vane exit area for an atomizing nozzle is the summation of the individual vane exit areas EA.

Preferred vanes 48 will feature a continuously inwardly decreasing width so that EW is generally less than IW while height H is generally constant over the length of each vane 48. Because height H is preferably maintained generally constant over the radial length of vane 48, the ratio of the vane exit area EA to vane inlet area IA is generally equal to the ratio of the vane exit width EW to vane inlet width IW. Consequently, both ratios preferably define the narrowing conformation of each vane 48. This narrowing conformation preferably provides a continuously accelerating liquid flow within each vane 48 as the liquid traverses each vane 48 in a direction from supply chamber 32 toward swirl chamber 42.

Although it is preferable that the width (and similarly the cross sectional area A if the vane height H is constant) of each vane 48 continuously decreases inwardly from cavity surface 39, it has been found that the spray characteristics of liquid dispensed from nozzles made according to this invention are generally insensitive to the amount of decrease in the vane width W. Thus, it is believed generally that the ratio of the vane exit width EW to the vane inlet width IW, and likewise the ratio of vane exit area EA to the vane inlet area IA (if vane height is constant), may vary in a range from about 0.10 to about 1.0 without generally deviating from the scope of this invention.

Not intending to be bound by any particular theory, it is believed that proper dimensioning of the cross sectional exit area EA of vanes 48 in cooperation with the proper sizing of chamber diameter CD and 1 or orifice diameter OD is critical to achieving the spray characteristics of the present invention. For example, it has been observed that as chamber diameter CD and individual and cumulative vane exit areas increase, the Sauter Mean Diameter (i.e., a quotient representing the average particle size of a spray) of a given spray generally decreases according to the following equation, and as graphically illustrated in FIG. 5:

$$SMD=44.6-57.1*(CD*EA)$$

where SMD=Sauter Mean Diameter in microns

CD=Chamber diameter for values generally in a range of between about 0.5 mm and about 1.5 mm EA=Individual vane exit area for values generally in the range of between about 0.02 $mm^2$ and about 0.07 about $mm^2$.

Figure 5:
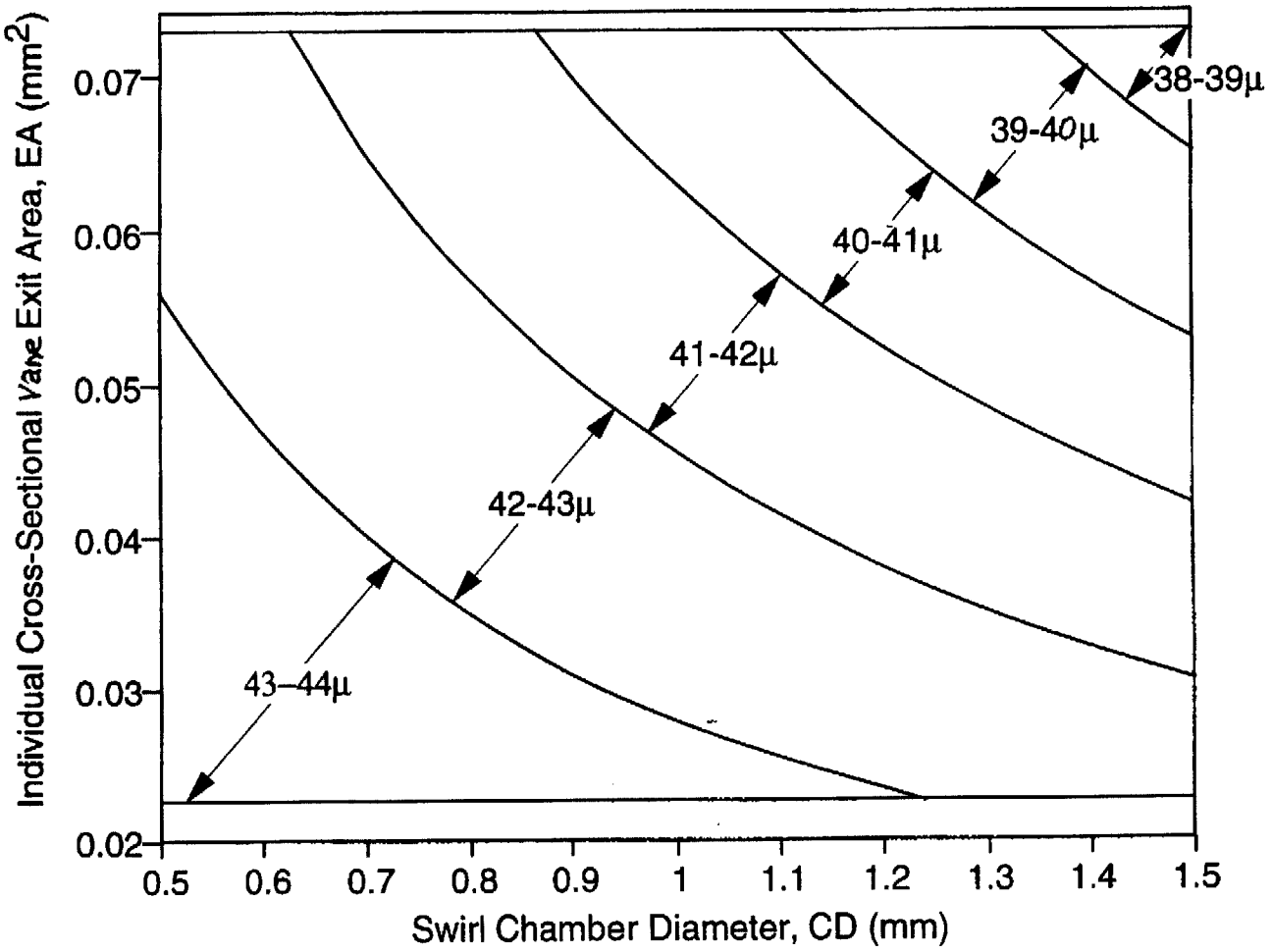
FIG. 5 is a graphical illustration of the general relationship between swirl chamber diameter and individual vane exit area in an atomizing nozzle.

Although FIG. 5 indicates a generally decreasing particle size as individual vane exit area EA and/or chamber diameter CD increase, data generally indicates that the Sauter Mean Diameter of a resulting spray was found to generally increase if the individual vane exit area EA is about 0.12 $mm^2$ and chamber diameter CD is about 2.0 mm.

Based on the foregoing relationships, it is believed that preferred embodiments of the present invention will have a cumulative vane exit area (i.e., a summation of the individual vane exit areas EA) in a range of between about 0.18 $mm^2$ and about 0.36 $mm^2$ and generally a chamber diameter CD in a range of between about 1.3 mm and about 2.0 mm, and most preferably the chamber diameter CD being in a range of between about 1.4 mm and about 1.5 mm. It has been found by the applicant that these preferred embodiments will generally produce a spray being in the range of between about 38 microns to about 43 microns with a liquid pressure being in the range of between about 160 psig to about 200 psig.

Nozzle body 20, feed tube 23, and nozzle insert 36 may be constructed from any substantially rigid material, such as steel, aluminum, or their alloys, fiberglass, or plastic. However, for economic reasons, each is most preferably composed of polyethylene plastic and formed by injection molding, although other processes such as plastic welding or adhesive connection of appropriate parts are equally applicable.

In operation of a preferred embodiment of the present invention, liquid product is provided from a container through feed tube 23 under pressure created by a manually-actuated piston and cylinder arrangement, or other manually actuated pump device. The fluid, upon exiting feed tube 23 enters supply chamber 32 whereupon it longitudinally traverses nozzle body 20 and enters supply annulus 50. The pressurized liquid then passes through supply annulus 50 and is directed into the plurality of vanes 48. Although it is preferred that feed tube 23, supply chamber 32 and supply annulus 50 cooperate to transport the liquid from the container to the plurality of vanes 48, it should be understood that other supply structures (e.g., channels, chambers, reservoirs etc.) may be equally suitable singly or in combination for this purpose. Preferably, the liquid is continuously accelerated by the decreasing cross sectional area A of each vane 48 which directs the liquid radially inward toward swirl chamber 42. The accelerated liquid preferably exits the vanes 48 generally tangentially into swirl chamber 42, and the rotational energy imparted to the liquid by each vane 48 and the tangential movement into swirl chamber 42 generally creates a low pressure region adjacent the center of swirl chamber 42. This low pressure region will tend to cause ambient air or gas to penetrate into the core of swirl chamber 42. The liquid then exits swirl chamber 42 as a thin liquid film (surrounding aforementioned air core) and is directed through discharge orifice 44 to the ambient environment. Upon discharge, inherent instabilities in the liquid film cause the liquid to break into ligaments and then discrete particles or droplets, thus forming a spray.

Figure 6:
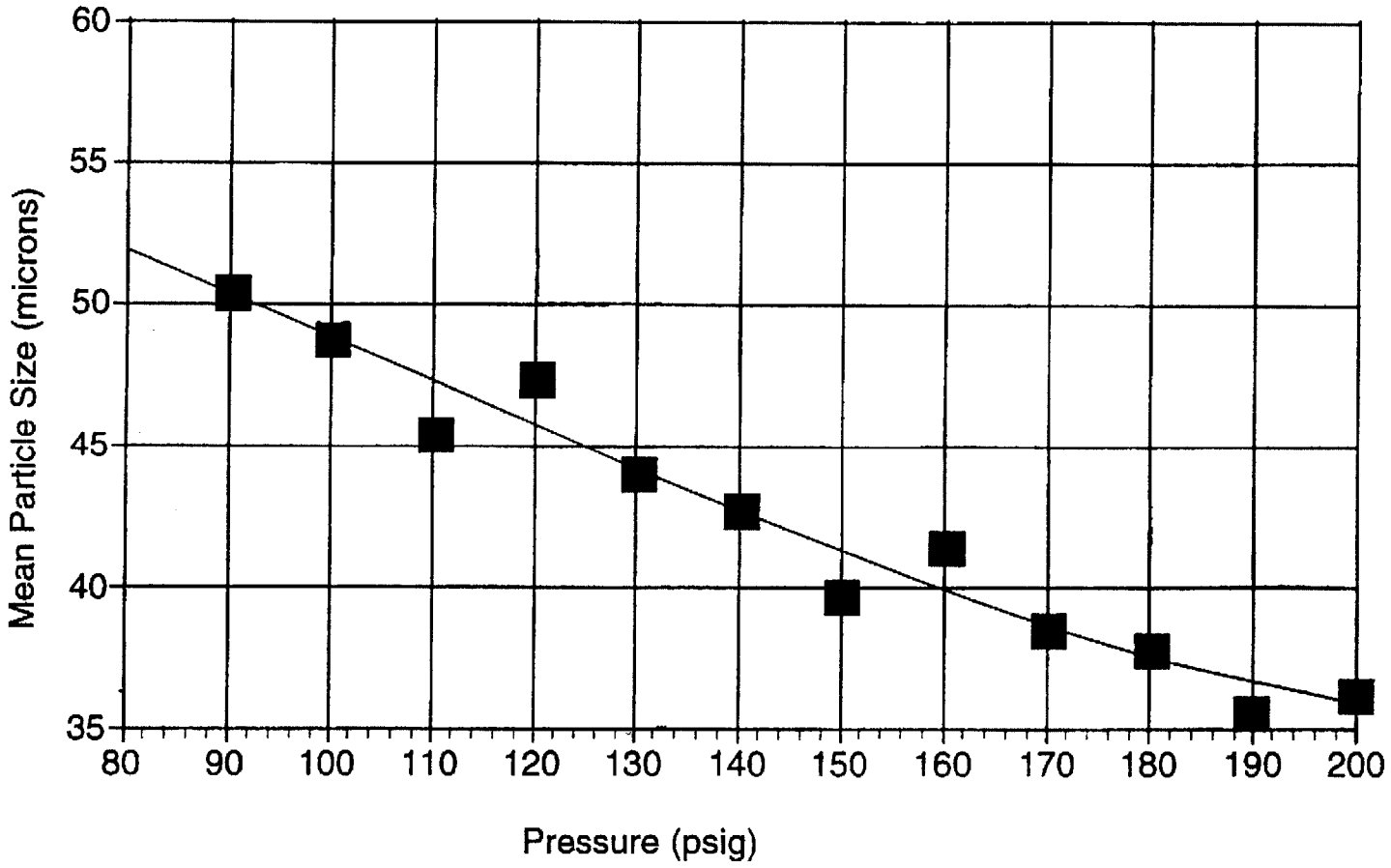
FIG. 6 is a graphical illustration of the general relationship between liquid pressure and mean particle size of an atomizing nozzle of the present invention.

As best illustrated in FIG. 6, a preferred embodiment of the present invention generates a spray of liquid particles or droplets having a mean particle size of about 40 microns at a fluid pressure of around 160 psig when used to dispense a fluid having a viscosity of about 10 centipoise. For comparison only, the best known commercially available nozzle of which the applicant is aware which may be adapted for use in a manual-actuated pump dispenser generally produces a spray having a mean particle size of about 40 microns at a pressure about 200 psig or more for a liquid of such viscosity. The approximate 40 psig pressure reduction in that example to achieve generally a 40 micron mean particle size advantageously translates into a lower input force to create the necessary fluid pressure. Consequently, the user of a manually-actuated pump type dispenser containing an atomizing nozzle embodying the present invention would have to exert less force to achieve generally a 40 micron spray, and the device itself would presumably be easier and less expensive to manufacture due to the lower pressure requirements.

While the structure of the present invention is not intended to be limited to the dispensing of any specific product or category of products, it is recognized that the structure of the preferred embodiments is particularly efficient and applicable for the dispensing, at pressures about 160 psig, of liquid products having a viscosity, density, and surface tension generally about 10 centipoise, 25 dynes per centimeter respectively. It will be understood by one skilled in the art, however, that deviation from these values for appropriate different applications and/or for dispensing of various liquids and viscosities should be possible without affecting the spray characteristics of the present invention. For example, it is believed that the viscosity of the liquid to be dispensed may vary from about 5 cps to 20 cps without deviating from the scope of this invention.

The foregoing description of the preferred embodiments of the invention has been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application, and indeed to thereby enable utilization of the invention in various embodiments and with various modifications as are suited to the particular use contemplated. It is intended that the scope of the invention be defined by the claims appended hereto.

I claim:

1. An atomizing nozzle for dispensing a liquid from a container in the form of a spray of liquid particles, the atomizing nozzle comprising:

a supply structure for transporting a liquid under manually generated pressure from a container;

a plurality of generally radial vanes;

a swirl chamber in fluid communication with the plurality of vanes and having a chamber diameter;

a discharge orifice in fluid communication and generally concentric with the swirl chamber and having an orifice diameter;

the swirl chamber diameter being in a range of between about 1.3 mm and about 2.0 mm; and the plurality of vanes generally decreasing in cross-sectional area toward the swirl chamber, each vane having an individual vane exit area being in a range of between about 0.06 $mm^2$ and about 0.12 $mm^2$.

2. The atomizing nozzle of claim 1, wherein the chamber diameter is in a range of between about 1.4 mm and about 1.5 mm.

3. The atomizing nozzle of claim 1, wherein the chamber diameter is about 1.5 mm.

4. The atomizing nozzle of claim 1, wherein the orifice diameter is about 0.35 mm.

5. The atomizing nozzle of claim 1, wherein the plurality of vanes have a cumulative vane exit area being in a range of between about 0.18 $mm^2$ and about 0.36 $mm^2$.

6. An atomizing nozzle for dispensing a liquid from a container, the atomizing nozzle comprising:

a substantially cup shaped nozzle insert having an insert surface and a cavity with an end face;

a plurality of generally radial grooves disposed on the end face;

a swirl chamber adjacent the end face and having a chamber diameter and being disposed generally concentric with the cavity and in fluid communication with the grooves, the chamber diameter being in a range of between about 1.3 mm and about 2.0 mm;

a discharge orifice having an orifice diameter and being disposed generally concentric with the swirl chamber and in fluid communication therewith;

a nozzle body for receiving and retaining the nozzle insert, the nozzle body having a supply chamber for receiving the liquid to be atomized under manually generated pump pressure from the container and an insert post being disposed generally within the supply chamber and having an end surface; and a plurality of generally radial vanes substantially defined by the end surface and the grooves, the plurality of vanes being in fluid communication with the supply chamber and generally decreasing in cross sectional area toward the swirl chamber and having a cumulative vane exit area being in a range of between about 0.18 $mm^2$ and about 0.36 $mm^2$.

7. The atomizing nozzle of claim 6, wherein the chamber diameter is in a range of between about 1.4 mm and about 1.5 mm.

8. The atomizing nozzle of claim 6, wherein the chamber diameter is about 1.5 mm.

9. The atomizing nozzle of claim 6, wherein the orifice diameter is about 0.35 mm.

10. The atomizing nozzle of claim 6, further comprising three vanes, each vane having an individual vane exit area being in a range of between about 0.06 $mm^2$ and about 0.12 $mm^2$.

11. A method of dispensing a liquid from a manually-actuated pump dispenser, comprising the following steps:

providing an atomizing nozzle having, in successive fluid communication, a supply chamber, a plurality of generally radial vanes with each vane having an individual vane exit area, a swirl chamber having a chamber diameter, and a discharge orifice, said chamber diameter being in a range of between about 1.3 mm and about 2.0 mm and said individual vane exit area being in a range of between about 0.06 $mm^2$ and about 0.12 $mm^2$;

providing a liquid having a viscosity being in range of between about 5 cps to about 20 cps from a container to the atomizing nozzle at pressure below about 200 psig by manually actuating a pump device;

directing the liquid into the plurality of generally radial vanes;

directing the liquid via the radial vanes into the swirl chamber; and creating an atomized spray by directing the liquid from the swirl chamber and through the discharge orifice such that the mean particle size of the liquid particles is in a range of between about 38 microns and about 43 microns.

12. The method of claim 11, wherein the step of providing the atomizing nozzle further comprises providing an atomizing nozzle having a cumulative vane exit area being in a range of between about 0.18 $mm^2$and about 0.36 $mm^2$.

13. The method of claim 11, wherein the step of providing the atomizing nozzle further comprises providing an atomizing nozzle having on orifice diameter of about 0.35 mm. a plurality of generally radial vanes substantially defined by the end surface and the grooves, the plurality of vanes being in fluid communication with the supply chamber and generally decreasing in cross sectional area toward the swirl chamber and having a cumulative vane exit area being in a range of between about 0.18 $mm^2$ and about 0.36 $mm^2$.

* * * * *

UNITED STATES PATENT AND TRADEMARK OFFICE

CERTIFICATE OF CORRECTION

PATENT NO. : 5,711,488
DATED : January 27, 1998
INVENTOR(S) : Lund

It is certified that error appears in the above-identified patent and that said Letters Patent is hereby corrected as shown below:

Column 2, line 47, please delete "he" and insert therefor --be--.

Column 5, line 50, please delete "and 1 or" and insert therefor --and/or--.

Claim 1, column 7, line 42, please insert --pump-- after "generated".

Claim 13, column 9, beginning at line 5, through col. 10, line 5, please delete inclusively from "a" inclusively to "$mm^2$."

Claim 13, column 9, line 5, please delete "on" and insert therefor --an--.

Signed and Sealed this

Second Day of June, 1998

*Attest:*

Bruce Lehman

BRUCE LEHMAN

*Attesting Officer*

*Commissioner of Patents and Trademarks*